US011480040B2

(12) United States Patent
Han et al.

(10) Patent No.: US 11,480,040 B2
(45) Date of Patent: Oct. 25, 2022

(54) ELECTRO-HYDRAULIC HYBRID DRIVE SAND-MIXING EQUIPMENT

(71) Applicant: YANTAI JEREH PETROLEUM EQUIPMENT & TECHNOLOGIES CO., LTD., Yantai (CN)

(72) Inventors: Maomao Han, Yantai (CN); Weiwei Liu, Yantai (CN); Yongcheng Liu, Yantai (CN); Yipeng Wu, Yantai (CN); Shuwei Li, Yantai (CN); Shijun Song, Yantai (CN); Lianpan Duan, Yantai (CN)

(73) Assignee: YANTAI JEREH PETROLEUM EQUIPMENT & TECHNOLOGIES CO., LTD., Yantai (CN)

( * ) Notice: Subject to any disclaimer, the term of this patent is extended or adjusted under 35 U.S.C. 154(b) by 304 days.

(21) Appl. No.: 16/834,453

(22) Filed: Mar. 30, 2020

(65) Prior Publication Data

US 2020/0400005 A1 Dec. 24, 2020

(30) Foreign Application Priority Data

Jun. 18, 2019 (CN) ..... 201910526665.9

(51) Int. Cl.
*E21B 43/26* (2006.01)
*B01F 35/32* (2022.01)
(Continued)

(52) U.S. Cl.
CPC ..... *E21B 43/2607* (2020.05); *B01F 35/3204* (2022.01); *B01F 35/32045* (2022.01);
(Continued)

(58) Field of Classification Search
CPC .... E21B 43/2607; E21B 43/26; E21B 43/267; B01F 35/3204; B01F 35/32045;
(Continued)

(56) References Cited

U.S. PATENT DOCUMENTS

2019/0009232 A1* 1/2019 Yeung ..... B01F 33/5023
2019/0226317 A1* 7/2019 Payne ..... E21B 44/00
2019/0271218 A1* 9/2019 Coli ..... B01F 35/71

FOREIGN PATENT DOCUMENTS

CN 103343679 A * 10/2013 ..... E21B 43/2607

* cited by examiner

*Primary Examiner* — James G Sayre
(74) *Attorney, Agent, or Firm* — Xsensus LLP

(57) ABSTRACT

The present invention discloses electro-hydraulic hybrid drive sand-mixing equipment, including a skid base, an electric motor, a hydraulic pump, a discharge centrifugal pump, a suction centrifugal pump, a mixing tank, a dry additive system, a liquid additive system, and a sand auger system. The electric motor, the hydraulic pump, the discharge centrifugal pump, the suction centrifugal pump, the mixing tank, the dry additive system, the liquid additive system, and the sand auger system are integrally skid mounted on the skid base. There are two electric motors, including a first electric motor and a second electric motor. The first electric motor drives the discharge centrifugal pump, and the second electric motor actuates the hydraulic pump, to drive the suction centrifugal pump, the mixing tank, the dry additive system, the liquid additive system, and the sand auger system. The electric motor is an integrated variable-frequency drive electric motor. Beneficial effects: Two integrated variable-frequency drive electric motors are applied. First, the setup of an independent variable-frequency drive cabinet is effectively omitted, that is, the overall size of the sand-mixing equipment is effectively reduced, so that it is more flexible and convenient to transport the equipment and arrange a well site. Next, a control system is simpler, thus optimizing the power matching of the sand-mixing equipment.

5 Claims, 1 Drawing Sheet

(51) Int. Cl.
*B01F 35/71* (2022.01)
*B01F 101/49* (2022.01)

(52) U.S. Cl.
CPC .... *B01F 35/7176* (2022.01); *B01F 35/71775* (2022.01); *E21B 43/26* (2013.01); *B01F 2101/49* (2022.01)

(58) Field of Classification Search
CPC ..... B01F 35/7176; B01F 35/71775; B01F 2101/49; B01F 23/59; B01F 33/5013; B01F 35/2214; B01F 35/3215; Y02P 70/10
See application file for complete search history.

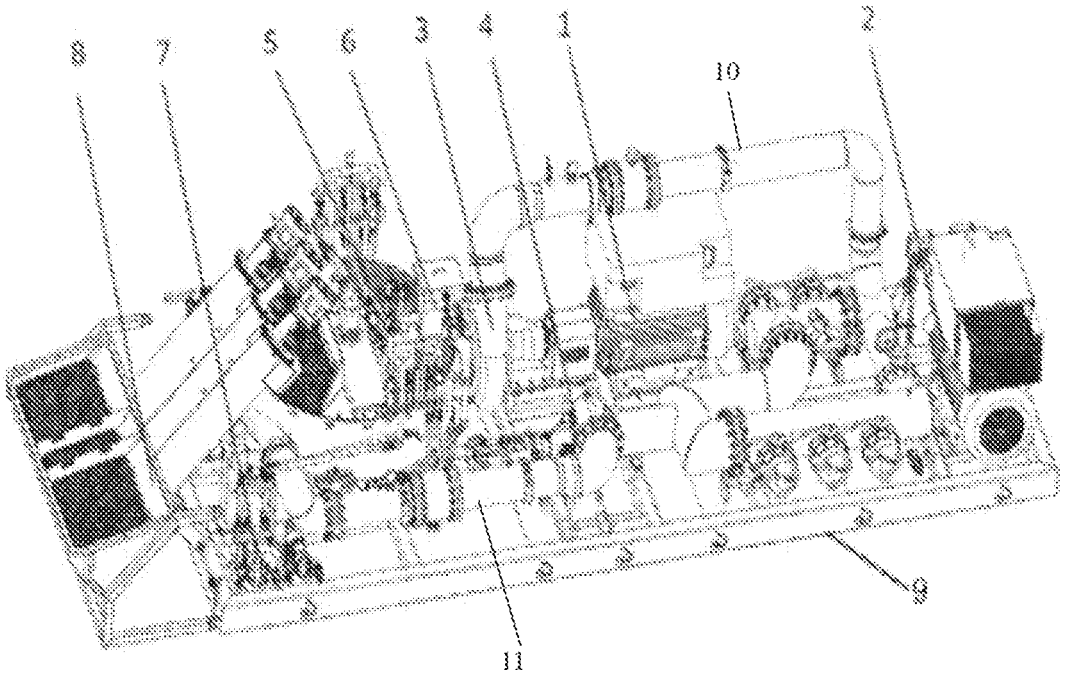
8
7
5
6
3
4
1
10
2
9
11

ELECTRO-HYDRAULIC HYBRID DRIVE SAND-MIXING EQUIPMENT

TECHNICAL FIELD

The present invention relates to the field of fracturing equipment in oil and gas fields, and specifically to electro-hydraulic hybrid drive sand-mixing equipment.

BACKGROUND

In a configuration mode of a power transmission system used in sand-mixing equipment on fracturing sites in oil and gas fields in China, a diesel engine drives a hydraulic system through a transfer case, and execution components such as a suction centrifugal pump, a discharge centrifugal pump, an auger, a liquid additive system, and a dry additive system are all driven by a hydraulic motor.

This configuration mode has the following disadvantages:

(1). Large volume and complex structure:

A diesel engine system includes an air intake system, an exhaust system, a heating system, a fuel system, a cooling system, and the like, and therefore has a complex structure and occupies a large space.

(2). Environmental problems: During operations on a well site, the sand-mixing equipment driven by the diesel engine generates engine exhaust pollution and noise pollution to severely affect the normal life of nearby residents. Moreover, fuel oil, engine oil, antifreeze, and the like are prone to leak to somewhat pollute the environment.

(3). Cost inefficiency: The sand-mixing equipment driven by the diesel engine requires relatively high initial purchase costs and incurs high fuel consumption costs for unit power during operations, and a power system also requires very high routine maintenance costs.

Efforts are made in China to manufacture oil and gas exploitation equipment with "low energy consumption, low noise, and low emission". Therefore, the foregoing disadvantages of conventional sand-mixing equipment that uses the diesel engine as a power source impedes the exploitation progress of unconventional oil and gas sources to some extent.

SUMMARY

To overcome the deficiencies in the prior art, an objective of the present invention is to provide electro-hydraulic hybrid drive sand-mixing equipment. Two electric motors are used as the power source. One electric motor drives a discharge centrifugal pump, and the other electric motor drives a hydraulic system to supply power to all functional components such as a suction centrifugal pump, an auger, a dry additive system, and a liquid additive system other than the discharge centrifugal pump. Electric motors are applied to eliminate various inconveniences and deficiencies during the use of conventional diesel engine equipment and improve the work capability and energy consumption efficiency of the equipment.

The objective of the present invention is achieved by the following technical measures: Electro-hydraulic hybrid drive sand-mixing equipment, including a skid base, an electric motor, a hydraulic pump, a discharge centrifugal pump, a suction centrifugal pump, a mixing tank, a dry additive system, a liquid additive system, and a sand auger system, where the electric motor, the hydraulic pump, the discharge centrifugal pump, the suction centrifugal pump, the mixing tank, the dry additive system, the liquid additive system, and the sand auger system are integrally skid mounted on the skid base, there are two electric motors, including a first electric motor and a second electric motor, the first electric motor is configured to drive the discharge centrifugal pump, the second electric motor actuates the hydraulic pump, to drive the suction centrifugal pump, the mixing tank, the dry additive system, the liquid additive system, and the sand auger system, and the electric motor is an integrated variable-frequency drive electric motor.

Further, the electro-hydraulic hybrid drive sand-mixing equipment further includes a suction manifold and a discharge manifold, and the suction manifold and the discharge manifold are separately disposed on a left side and a right side of the skid base.

Further, the second electric motor is disposed at a front end portion of the skid base.

Further, the first electric motor is connected to the discharge centrifugal pump through a coupling, the first electric motor is disposed on a side of the discharge manifold, and the first electric motor and the discharge manifold are arranged up and down in space.

Further, the second electric motor actuates the hydraulic pump through a transfer case.

Compared with the prior art, the beneficial effects of the present invention are as follows:

1. Two electric motors are used to separately drive a discharge centrifugal pump and components other than the discharge centrifugal pump of the sand-mixing equipment, thereby effectively optimizing the configuration of the electric motor and optimizing a power system configuration of the sand-mixing equipment. (To satisfy a working requirement, the electric motor that drives the suction centrifugal pump needs to satisfy a maximum power requirement of the suction centrifugal pump, and the electric motor that drives a hydraulic system needs to satisfy a maximum power requirement for driving all components of the hydraulic system, with the total power of the two electric motors being relatively large. When one electric motor is used to drive the suction centrifugal pump and the remaining systems, because the suction centrifugal pump and the remaining systems do not reach maximum outputs at the same time during actual applications, the power of the electric motor may be corrected and reduced, so that the required power can be reduced by 15%, costs are lower, the configuration of the power system is more superior, and the overall equipment is smaller, lighter, and more compact.)

2. An integrated variable-frequency drive electric motor is chosen, and an inverter function is integrated on the electric motor, so that a diesel engine system has a less complex structure and occupies a smaller space. Moreover, with the application of the integrated variable-frequency drive electric motor, the setup of an independent variable-frequency drive cabinet is omitted. The implementation of these solutions effectively reduces the overall size of the equipment. The size of conventional equipment is reduced from 12.5 m×2.55 m×3.0 m to 9.6 m×2.55 m×3.0 m. The greatly reduced length makes it more flexible and convenient to transport the equipment and arrange a well site.

3. Two integrated variable-frequency drive electric motors are used to control the components of the entire sand-mixing equipment, so that a control system is simpler, the electric motor that drives the hydraulic pump may be directly set to a constant speed during operations, and it is only necessary to adjust rotational speeds of various functional components as required during working to implement control.

The present invention will be described below in detail with reference to the accompanying drawings and specific implementations.

BRIEF DESCRIPTION OF THE DRAWINGS

FIG. 1 is a schematic structural diagram of electro-hydraulic hybrid drive sand-mixing equipment.

Where: 1. first electric motor, 2. second electric motor, 3. discharge centrifugal pump, 4 suction centrifugal pump, 5. mixing tank, 6. dry additive system, 7. liquid additive system, 8. sand auger system, 9. skid base, 10. discharge manifold, and 11. suction manifold.

DESCRIPTION OF THE EMBODIMENTS

As shown in FIG. 1, electro-hydraulic hybrid drive sand-mixing equipment, including a skid base 9, an electric motor, a hydraulic pump, a discharge centrifugal pump 3, a suction centrifugal pump 4, a mixing tank 5, a dry additive system 6, a liquid additive system 7, a sand auger system 8, a suction manifold, and a discharge manifold. The electric motor, the hydraulic pump, the discharge centrifugal pump 3, the suction centrifugal pump 4, the mixing tank 5, the dry additive system 6, the liquid additive system 7, the sand auger system 8, the suction manifold, and the discharge manifold are integrally skid mounted on the skid base 9. There are two electric motors, including a first electric motor 1 and a second electric motor 2. The first electric motor 1 is configured to drive the discharge centrifugal pump 3. The discharge centrifugal pump 3 is directly driven by the first electric motor 1, so that the input power of the pump can be conveniently and effectively improved, thereby improving the work capability of the equipment. The second electric motor 2 actuates the hydraulic pump through a transfer case, to drive the suction centrifugal pump 4, the mixing tank 5, the dry additive system 6, the liquid additive system 7, and the sand auger system 8. The two electric motors are used to separately drive the discharge centrifugal pump 3 and components other than the discharge centrifugal pump 3 of the sand-mixing equipment, thereby effectively optimizing the configuration of the electric motor and optimizing a power system configuration of the sand-mixing equipment. The electric motor is an integrated variable-frequency drive electric motor. The integrated variable-frequency drive electric motor is chosen, and an inverter function is integrated on the electric motor, so that a diesel engine system has a less complex structure and occupies a smaller space. Moreover, with the application of the integrated variable-frequency drive electric motor, the setup of an independent variable-frequency drive cabinet is omitted. The implementation of these solutions effectively reduces the overall size of the equipment. The size of conventional equipment is reduced from 12.5 m×2.55 m×3.0 m to 9.6 m×2.55 m×3.0 m. The greatly reduced length makes it more flexible and convenient to transport the equipment and arrange a well site. Two integrated variable-frequency drive electric motors are used to control the components of the entire sand-mixing equipment, so that a control system is simpler, the electric motor that drives the hydraulic pump may be directly set to a constant speed during operations, and it is only necessary to adjust rotational speeds of various functional components as required during working to implement control. The second electric motor 2 is disposed at a front end portion of the skid base 9. The suction manifold and the discharge manifold are separately disposed on a left side and a right side, near an end of the second electric motor 2, of the skid base 9. A suction port and a discharge port face an outer side surface of the sand-mixing equipment. The sand auger system 8 is located at the rearmost portion of the sand-mixing equipment. The mixing tank 5 is arranged at an end near the sand auger system 8. A sand outlet of the sand auger system 8 is disposed over the mixing tank 5. A liquid inlet of the mixing tank 5 is connected to the suction manifold. A liquid outlet of the mixing tank 5 is connected to the discharge manifold. The discharge centrifugal pump 3 and the suction centrifugal pump 4 are disposed at the middle portion of the skid base 9. The first electric motor 1 is connected to the discharge centrifugal pump 3 through a coupling. The first electric motor 1 is disposed on a side of the discharge manifold, and the first electric motor 1 and the discharge manifold are arranged up and down in space. An arrangement solution of the first electric motor 1 and the discharge manifold ensures that the overall size of the equipment is effectively reduced.

Working Principle:

The discharge centrifugal pump 3 is directly driven by the first electric motor 1. An operator controls the rotational speed of the discharge centrifugal pump 3 in a control room to control the working displacement. The second electric motor 2 actuates the hydraulic pump through the transfer case, to drive the suction centrifugal pump 4, a stirrer of the mixing tank 5, the dry additive system 6, the liquid additive system 7, and the sand auger system 8. During working, an upstream fracturing base fluid is sucked from the suction port and is injected into the mixing tank 5 by the suction centrifugal pump 4. A proppant is conveyed into the mixing tank 5 by the sand auger system 8. A dry additive is conveyed into the mixing tank 5 by the dry additive system 6. The proppant, the fracturing base fluid, the dry additive, and the like are thoroughly mixed in the mixing tank 5 to form a fracturing fluid. The fracturing fluid is pressurized and conveyed by the discharge centrifugal pump 3 to downstream pumping equipment. According to working requirements, a liquid additive may be injected into the mixing tank 5, the suction manifold or the discharge manifold through the liquid additive system 7.

It will be appreciated to persons skilled in the art that the present invention is not limited to the foregoing embodiments, which together with the context described in the specification are only used to illustrate the principle of the present invention. Various changes and improvements may be made to the present invention without departing from the spirit and scope of the present invention. All these changes and improvements shall fall within the protection scope of the present invention. The protection scope of the present invention is defined by the appended claims and equivalents thereof.

What is claimed is:

1. Electro-hydraulic hybrid drive sand-mixing equipment, comprising a skid base, two electric motors, a hydraulic pump, a discharge centrifugal pump, a suction centrifugal pump, a mixing tank, a dry additive system, a liquid additive system, and a sand auger system, wherein the electric motor, the hydraulic pump, the discharge centrifugal pump, the suction centrifugal pump, the mixing tank, the dry additive system, the liquid additive system, and the sand auger system are integrally skid mounted on the skid base, the two electric motors comprise a first electric motor and a second electric motor, the first electric motor is configured to drive the discharge centrifugal pump, the second electric motor actuates the hydraulic pump, to drive the suction centrifugal pump, the mixing tank, the dry additive system, the liquid additive system, and the sand auger system, and each of the electric motors is an integrated variable-frequency drive electric motor.

2. The electro-hydraulic hybrid drive sand-mixing equipment according to claim 1, wherein the electro-hydraulic hybrid drive sand-mixing equipment further comprises a suction manifold and a discharge manifold, and the suction manifold and the discharge manifold are separately disposed on a left side and a right side of the skid base.

3. The electro-hydraulic hybrid drive sand-mixing equipment according to claim 2, wherein the first electric motor is connected to the discharge centrifugal pump through a coupling, the first electric motor is disposed on a side of the discharge manifold, and the discharge manifold is disposed crossing above the first electric motor.

4. The electro-hydraulic hybrid drive sand-mixing equipment according to claim 1, wherein the second electric motor is disposed at a front end portion of the skid base.

5. The electro-hydraulic hybrid drive sand-mixing equipment according to claim 1, wherein the second electric motor actuates the hydraulic pump through a transfer case.

* * * * *